US006431364B1

(12) United States Patent
Saladyga

(10) Patent No.: US 6,431,364 B1
(45) Date of Patent: Aug. 13, 2002

(54) DISPLAY WITH REMOVEABLE INFORMATIONAL PANEL

(75) Inventor: Kevin Saladyga, Beaver County, PA (US)

(73) Assignee: Packaging Specialists, Inc., Clinton, PA (US)

( * ) Notice: Subject to any disclaimer, the term of this patent is extended or adjusted under 35 U.S.C. 154(b) by 0 days.

(21) Appl. No.: 09/640,137

(22) Filed: Aug. 16, 2000

(51) Int. Cl.[7] ..... B65D 25/00; B65D 85/00

(52) U.S. Cl. ..... 206/767; 206/459.5; 40/312

(58) Field of Search ..... 206/766–768, 206/459.1, 459.5, 831, 45.28, 45.29; 40/312; 229/164

(56) References Cited

U.S. PATENT DOCUMENTS

| | | | | | |
|---|---|---|---|---|---|
| 529,760 | A | * | 11/1894 | Stevens | 40/312 |
| 933,004 | A | * | 8/1909 | Stingily | 40/312 |
| 1,279,772 | A | * | 9/1918 | Soulee | 40/312 |
| 1,310,765 | A | * | 7/1919 | Myers | 206/45.29 |
| 1,497,519 | A | * | 6/1924 | Lewis | 206/45.29 |
| 1,557,332 | A | | 10/1925 | Robbins | |
| 1,649,211 | A | | 11/1927 | Bitzer | |
| 1,932,429 | A | * | 10/1933 | Wellman | 229/164 |
| 2,136,797 | A | | 11/1938 | Lee | |
| 2,964,169 | A | * | 12/1960 | Brachman | 260/766 |
| 3,674,133 | A | | 7/1972 | Locke | |
| 3,690,450 | A | * | 9/1972 | Sheldon | 40/312 |
| 3,912,158 | A | | 10/1975 | Taub | |
| 3,924,734 | A | | 12/1975 | Gardner | |
| 4,206,869 | A | | 6/1980 | Gurevitz | |
| 4,756,409 | A | | 7/1988 | Murray | |
| 6,109,514 | A | * | 8/2000 | Otis | 206/459.5 |

* cited by examiner

*Primary Examiner*—Bryon P. Gehman
(74) *Attorney, Agent, or Firm*—Buchanan Ingersoll, P.C.

(57) ABSTRACT

A display tray is provided for visually displaying a plurality of products for sale, and also for displaying promotional information regarding the products within the tray. The display tray includes a tray member into which the products for sale are placed, and a display member separate from and removeably connected to the tray member for displaying promotional information regarding the products within the tray member.

18 Claims, 3 Drawing Sheets

DISPLAY WITH REMOVEABLE INFORMATIONAL PANEL

FIELD OF THE INVENTION

The present invention is directed toward display trays for displaying articles for sale and, more particularly, toward display trays having removeable informational panels containing information regarding the articles displayed for sale.

BACKGROUND OF THE INVENTION

Display trays for use in supermarkets, retail stores, and the like, currently take many different physical forms and are made from various materials using various techniques. These prior art display trays are generally for point-of-purchase impact of the products displayed within by prospective buyers.

One problem with many of these prior art display trays is that they require the use of glue, or some other type of adhesive means, in order to form the assembled tray. This increases the manufacturing cost of the display tray in terms of both material and labor. Also, it is generally desired to provide promotional information regarding the product displayed within the display tray in order to attract a prospective buyer's attention. Typically, such information is provided as a label adhered to the display tray or is printed directly on the display tray. If printed directly on the display tray, the tray will then generally not be available for use with a different type of product, since the information on the front of the tray will be inaccurate. If provided as a label, the information is typically hard to remove without damaging or destroying the tray, or especially if the tray is made of cardboard or corrugated paper.

The present invention is directed toward overcoming one or more of the above-mentioned problems.

SUMMARY OF THE INVENTION

A display tray is provided for visually displaying a plurality of products for sale, and also for displaying promotional information regarding the products within the tray. The display tray includes a tray member into which the products for sale are placed, and a display member or informational panel separate from and removeably connected to the tray member for displaying promotional information regarding the products within the tray member.

The tray member is made from a unitary blank of stiff material cut and provided with cuts, cut outs, fold or score lines, tabs and slots to provide the tray member, when assembled, with a bottom panel, rear and front panels extending upwardly from opposite edges of the bottom panel, with the front panel of lesser height than the rear panel, and side panels extending upwardly from opposite edges of the bottom panel and interconnecting the front panel with the rear panel. The display member is also made from a unitary blank of stiff material and is separate from the tray member. The display member includes a display panel for displaying promotional information regarding the products within the tray member, and a pair of wing panels provided on opposite sides of the display panel. The wing panels are folded and disposed in surface abutting relationship with the side panels of the tray member with the display panel in surfacing abutting relationship with the front panel of the tray member. Engagement of the wing panels with the side panels removeably connects the display member to the tray member. Neither the assembly of the tray member nor the removeable connection of the display member with the tray member is accomplished with the use of glue, tape, or any other adhesive means.

In one form, the display panel includes an upper portion and a lower portion connected via a fold line extending the length of the display panel. The lower portion is foldable between a first position underneath the bottom panel and a second position extending substantially perpendicular to and downwardly from the bottom panel for engaging a front of a shelf on which the display tray is placed.

In another form, the side panels each include an outer side surface, or panel, and an inner side surface, or panel, connected to the outer side surface via a fold line. When assembled, the wing panels are disposed between the outer and inner side surfaces of the side panels, with the display member removeably connected to the tray member via engagement of the wing panels with the outer side surfaces, inner side surfaces and the fold lines connecting the inner and outer side surfaces.

The stiff material of the tray and display members may include such materials as cardboard, corrugated paper, bristol board, stiff plastic, and other similar materials. The tray and display members need not be made of the same stiff material.

It is an object of the present invention to provide a display tray for displaying articles for sale, the display tray assembled without the use of glue or other adhesive means.

It is a further object of the present invention to provide a display tray for displaying a plurality of different types of articles for sale, and also for displaying promotional information regarding each of the different products within the display tray.

Other aspects, objects and advantages of the present invention could be obtained from the study of the application, the drawings, and the appended claims.

DETAILED DESCRIPTION OF THE INVENTION

Figure 1:
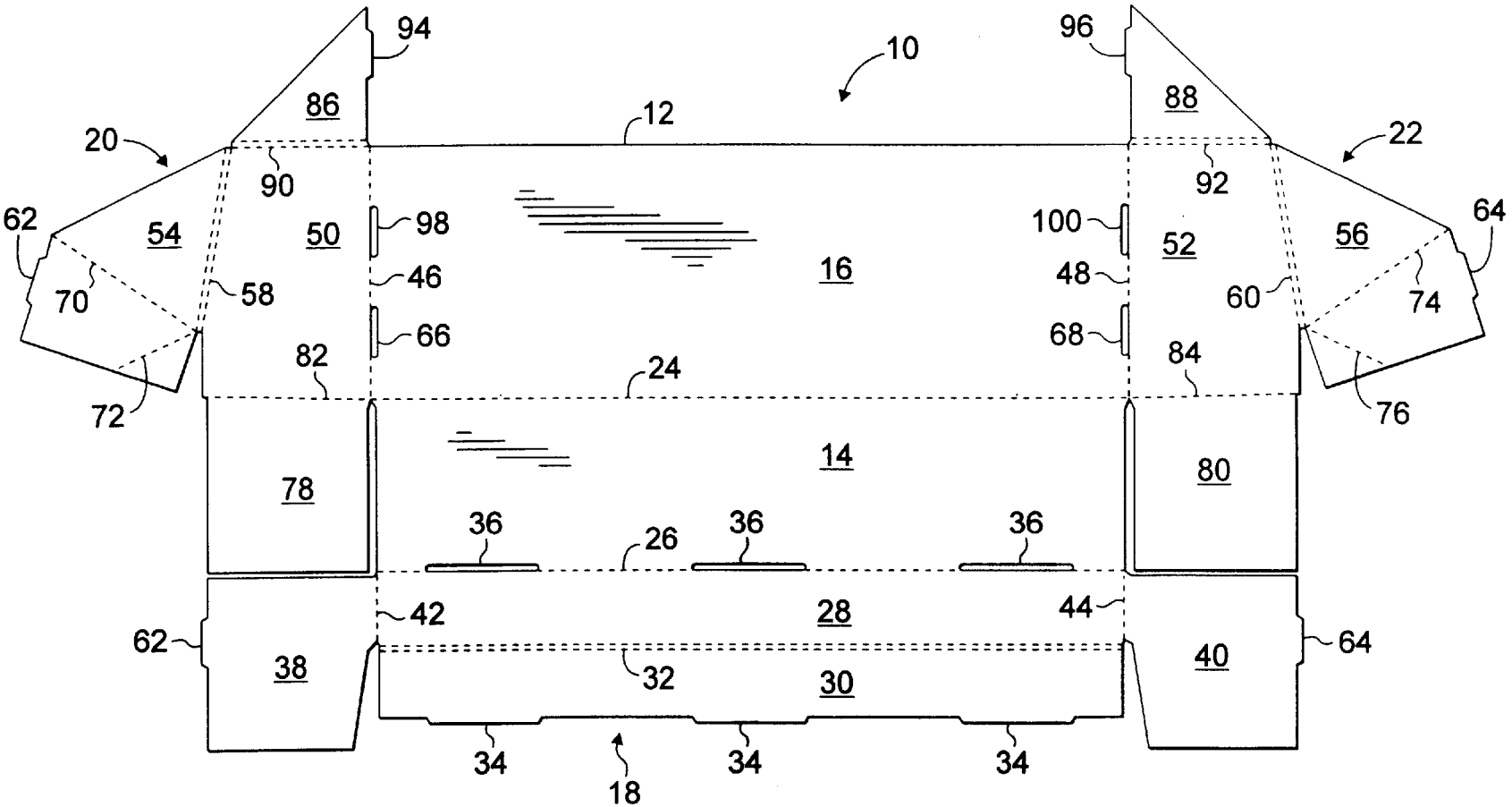
FIG. 1 is a plain view of a blank used in forming the tray member of the present invention.

As shown in FIG. 1, the tray member 10 is fabricated from a unitary blank 12 of stiff material, such as cardboard, corrugated paper, bristol board, stiff plastic material (e.g., polyvinylchloride), and the like. The unitary blank 12 of stiff material includes a bottom panel 14, a rear panel 16, a front panel 18, and side panels 20 and 22. The rear panel 16 is hinged to the bottom panel 14 via fold line 24 and extends substantially perpendicular from the bottom panel 14 with the tray member 10 assembled. The front panel 18 is hinged to the bottom panel 14 via fold line 26 and also extends substantially perpendicular to the bottom panel 14 with the tray member 10 assembled. Typically, the front panel 18 is of lesser height than the rear panel 16. The front panel 18 includes an outer front panel 28 hinged to the bottom panel 14 via fold line 26 and an inner front panel 30 hinged to the outer front panel 28 via fold line 32. The inner front panel 30 include a plurality of tabs 34 which are received in a corresponding plurality of slots 36 formed in the bottom panel 14 adjacent the fold line 26 with the tray member 10 assembled. The front panel 18 also includes lateral panels 38 and 40 hinged to opposite edges of the outer front panel 28 via fold lines 42 and 44, respectively. The lateral panels 38 and 40 are folded and disposed parallel to the side panels 20 and 22 with the tray member 10 assembled.

The side panels 20 and 22 are hinged to opposite edges of the rear panel 16 via fold lines 46 and 48, respectively, and extend substantially perpendicular to the rear panel 16 with the tray member 10 assembled. The side panels 20 and 22 include outer side panels 50 and 52, defining outer side surfaces, hinged to the rear panel 16 via fold lines 46 and 48, and inner side panels 54 and 56, defining inner side surfaces, hinged to the outer side panels 50 and 52 via fold lines 58 and 60. The inner side panels 54 and 56 include tabs 62 and 64 which are received in slots 66 and 68 formed in the rear member 16 adjacent the fold lines 46 and 48, respectively, with the tray member 10 assembled. To facilitate assembly of the tray member 10, the inner side panels 54 and 56 are provided with fold lines 70, 72 and 74, 76, respectively.

The side panels 20 and 22 also include lower panels 78 and 80 hinged to the outer side panels 50 and 52 via fold lines 82 and 84. With the tray member 10 assembled, the lower panels 78 and 80 lie substantially perpendicular to the side walls 20 and 22 and are disposed on top of the bottom panel 14.

Additionally, the side panels 20 and 22 include finishing panels 86 and 88 hinged to the outer side panels 50 and 52 via fold lines 90 and 92. The finishing panels 86 and 88 include tabs 94 and 96 which are received in slots 98 and 100 formed in the rear panel 16 adjacent the fold lines 46 and 48, respectively, with the tray member 10 assembled. The finishing panels 86 and 88 along with the inner side panels 54 and 56, generally form the inner walls of the side panels 20 and 22.

Figure 2:
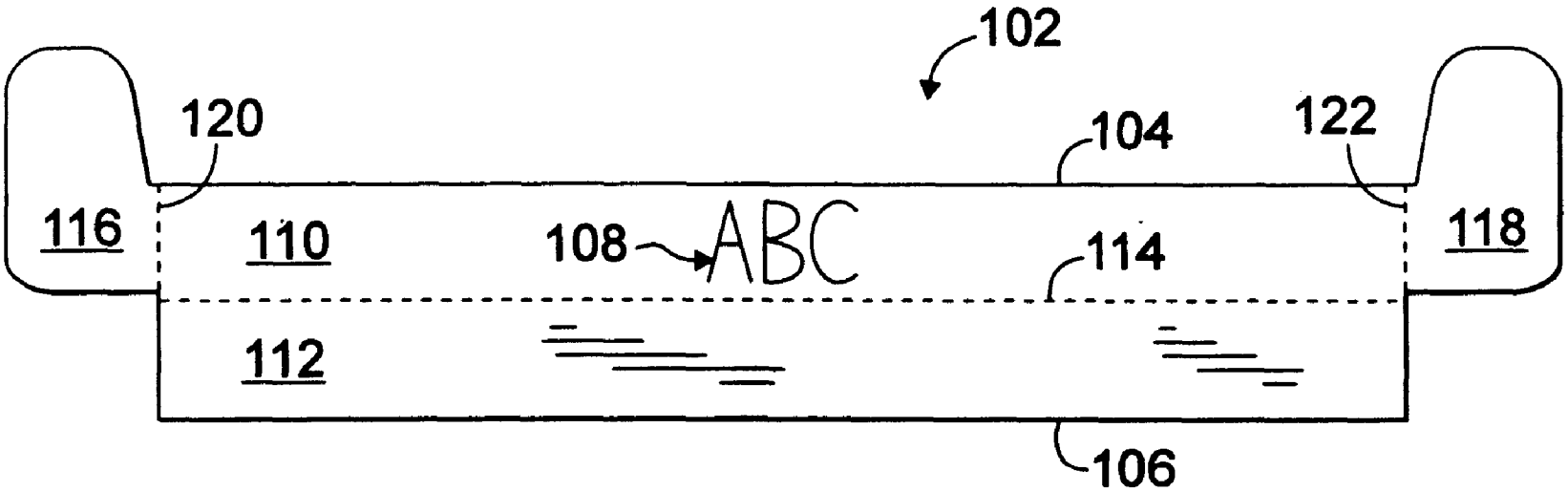
FIG. 2 is a plain view of a blank used in forming the display member of the present invention.

As shown in FIG. 2, a display member 102 according to the present invention is fabricated from a single unitary blank 104 of stiff material, such as cardboard, corrugated paper, bristol board, stiff plastic material and the like. Preferably, both the tray member 10 and the display member 102 are made of the same type of stiff material, however, similarity of material is not required.

The display member 102 includes a display panel 106 for displaying promotional information, shown at 108, regarding the products displayed for sale within the tray member 10. The display panel 106 includes an upper portion 110 and a lower portion 112 connected via a fold line 114. The display member 102 also includes wing panels 116 and 118 hinged to opposite edges of the upper portion 110 of the display panel 106 via fold lines 120 and 122.

Figure 3:
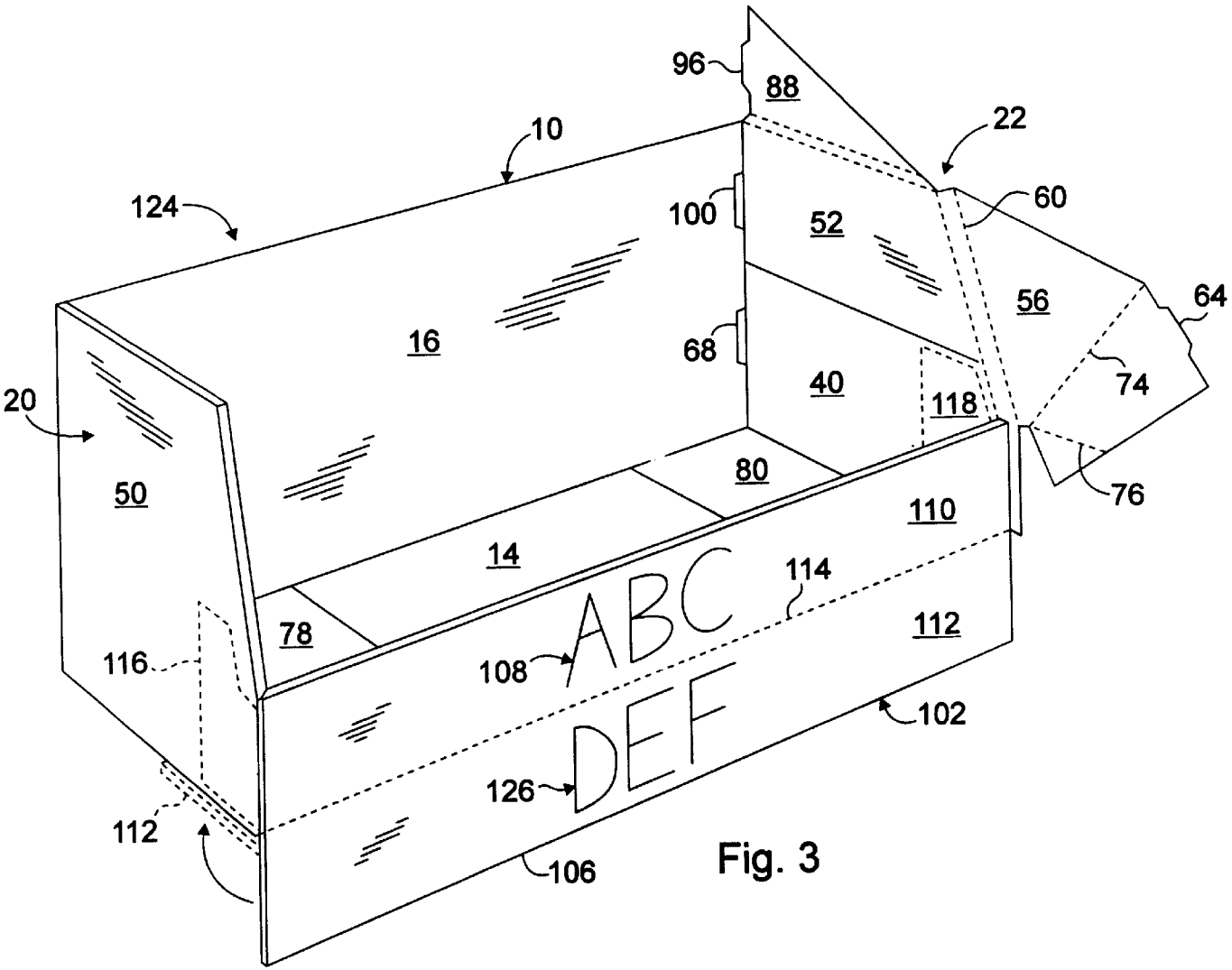
FIG. 3 is a perspective view illustrating assembly of the tray and display members to form the inventive display tray.

FIG. 3 illustrates the inventive display tray 124 formed from the tray member 10 and display member 102. Referring to FIGS. 1–3, assembly of the inventive display tray 124 will now be described.

The lower panels 78 and 80 of the side panels 20 and 22 are folded perpendicular to the outer side panels 50 and 52 at the fold lines 82 and 84. The side panels 20 and 22 are folded perpendicular to the rear panel 16 at the fold lines 46 and 48. Folding in this manner results in the lower panels 78 and 80 being disposed on top of the bottom panel 14 as illustrated in FIG. 3.

The lateral panels 38 and 40 are folded perpendicular to the front panel 18 at fold lines 42 and 44. The front panel 18 is folded perpendicular to the bottom panel 14 at the fold line 26. The inner front panel 30 is folded over the outer front panel 28 at the fold line 32, with the tabs 34 on the inner front panel 30 received in the slots 36. Folding in this manner results in the lateral panels 38 and 40 being disposed substantially parallel to the side walls 20 and 22. The tabs 62 and 64 in the lateral panels 38 and 40 are received in the slots 66 and 68 formed in the rear panel 16.

The wing panels 116 and 118 of the display member 102 are folded perpendicular to the display panel 106 and are inserted between the outer side panels 50 and 52 and the lateral panels 38 and 40. The wing panels 116 and 118 are shown in dotted form in FIG. 3.

The inner side panels 54 and 56 are folded over the outer side panels 50 and 52 at the fold lines 58 and 60, with the tabs 62 and 64 on the inner side panels 54 and 56 received in the slots 66 and 68 to maintain assembly of the display tray 124. So that the inner side panels 54 and 56 may be folded over the front panel 18, the inner side panels 54 and 56 are provided with appropriate fold lines 70, 72 and 74, 76. Finally, the finishing tabs 94 and 96 may be folded over the outer side panels 50 and 52 at the fold lines 90 and 92, and the tabs 94 and 96 received in the slots 98 and 100. Generally, the finishing panels 86 and 88 are provided for esthetic purposes.

Assembly of the display tray 124 in the above-described manner, permits the display member 102 to be removeably held in place on the tray member 10 without the need for glue or other adhesives means. The display member 102 is maintained in a secured position via engagement of the wing panels 116 and 118 with the side panels 20 and 22. More specifically, the wing panels 116 and 118, and thus the display member 102, are held in place via cooperating engagement with the outer side panels 50 and 52, inner side panels 54 and 56, and the fold lines 58 and 60 connecting the two.

As shown in FIG. 3, in assembled form, the lower portion 112 of the display member 102 extends downwardly from the bottom panel 14. The lower portion 112 of the display panel 106 may engage a front of a shelf (not shown) on which the display tray 124 is placed, thus prohibiting rearward movement of the display tray 124 with respect to the shelf. The lower portion 112 is foldable, via the fold line 114, between a first position, shown in dotted form in FIG. 3, underneath the bottom panel 14, and a second position extending downwardly from the bottom panel 14. The lower portion 112 of the display panel 106 may include additional promotional information, shown at 126, regarding the products displayed in the tray member 10.

With the display tray 124 of the present invention, the display member 102 may be easily removed, and a new display member, containing promotional information regarding a different product to be displayed in the tray member 10, may be replaced therefor. In this manner, the display tray 124 may be utilized to display for sale and provide promotional information for a variety of different types of products without the need for a new tray each time a new product is desired to be offered for sale.

While the present invention has been described with particular reference to the drawings, it should be understood that various modification could be made without departing from the spirit and scope of the present invention.

I claim:

1. A display tray for visually displaying a plurality of products within the tray and for displaying promotional information regarding the products within the tray, said display tray comprising:

a tray member made from a unitary blank of stiff material cut and provided with fold lines to provide the tray member with a bottom panel, a rear panel extending upwardly from an edge of the bottom panel, a front panel of lesser height than the rear panel extending upwardly from an edge of the bottom panel opposite the rear panel edge and in substantially parallel relationship to the rear panel, and a pair of side panels extending upwardly from opposite edges of the bottom panel and interconnecting the front panel with the rear panel; and a display member separate from and removeably connected to the tray member, the display member including a display panel for displaying promotional information regarding the products within the tray member, and a pair of wing panels integral with and disposed on opposite sides of the display panel, the wing panels folded and disposed in surface abutting relationship with the side panels with the display panel in surface abutting relationship with the front panel, wherein the display member is removeably connected to the tray member via engagement of the wing panels with the side panels.

2. The display tray of claim 1, wherein the display panel includes an upper portion and a lower portion extending downwardly from the bottom panel for engaging a front of a shelf on which the display tray is placed.

3. The display tray of claim 2, wherein the upper and lower portions are connected via a fold line, and wherein the lower portion is foldable between a first position underneath the bottom panel and a second position extending substantially perpendicular to and downwardly from the bottom panel.

4. The display tray of claim 1, wherein the side panels each include an outer side surface and an inner side surface connected to the outer side surface via a fold line, and wherein the wing panels are disposed between the outer and inner side surfaces, with the display member removeably connected to the tray member via engagement of the wing panels with the outer side surfaces, inner side surfaces and the fold line connecting the inner and outer side surfaces.

5. The display tray of claim 1, wherein the display member is made from a unitary blank of stiff material.

6. The display tray of claim 5, wherein the stiff material of the tray and display members is selected from the group consisting of cardboard, corrugated paper, bristol board and stiff plastic.

7. A display tray for visually displaying a plurality of products within the tray and for displaying promotional information regarding the products within the tray, said display tray comprising:

a tray member made from a unitary blank of stiff material, the tray member having a bottom panel, a rear panel hinged to the bottom panel and extending substantially perpendicular therefrom, side panels hinged to opposite edges of the rear panel and extending substantially perpendicular therefrom, each side panel including an outer side panel hinged to the rear panel, an inner side panel hinged to the outer side panel and including a tab received in a slot formed in the rear panel adjacent the outer side panel, and a lower panel hinged to the outer side panel and disposed on top of the bottom panel, and a front panel hinged to the bottom panel and extending substantially perpendicular therefrom, the front panel including an outer front panel hinged to the bottom panel, an inner front panel hinged to the outer front panel and including a tab received in a slot formed in the bottom panel adjacent the outer front panel, and lateral panels hinged to opposite edges of the outer front panel, the lateral panels being disposed parallel to the side panels and received between the inner and outer side panels; and a display member separate from and removeably connected to the tray member, the display member including a display panel for displaying promotional information regarding the products within the tray member, and wing panels hinged to opposite edges of the display panel and extending substantially perpendicular therefrom, the wing panels being parallel to the side panels and disposed between the lateral panels and the outer side panels with the display panel in surface abutting relationship with the front panel, and wherein engagement of the wing panels with the side panels removeably connects the display member with the tray member.

8. The display tray of claim 7, wherein the display panel includes an upper portion and a lower portion extending downwardly from the bottom panel for engaging a front of a shelf on which the display tray is placed.

9. The display tray of claim 8, wherein the upper and lower portions are connected via a fold line, and wherein the lower portion is foldable between a first position underneath the bottom panel and a second position extending substantially perpendicular to and downwardly from the bottom panel.

10. The display tray of claim 7, wherein the display member is made from a unitary blank of stiff material.

11. The display tray of claim 10, wherein the stiff material of the tray and display members is selected from the group consisting of cardboard, corrugated paper, bristol board and stiff plastic.

12. The display tray of claim 7, wherein the front panel is of lesser height than the rear panel.

13. A display tray for visually displaying a plurality of first and second products within the tray and for displaying promotional information regarding the first and second products within the tray, said display comprising:

a tray member made from a unitary blank of stiff material, the tray member having a bottom panel, a rear panel hinged to the bottom panel and extending substantially perpendicular therefrom, side panels hinged to opposite edges of the rear panel and extending substantially perpendicular therefrom, each side panel including an outer side panel hinged to the rear panel, an inner side panel hinged to the outer side panel and including a tab received in a slot formed in the rear panel adjacent the outer side panel, and a lower panel hinged to the outer side panel and disposed on top of the bottom panel, and a front panel hinged to the bottom panel and extending substantially perpendicular therefrom, the front panel including an outer front panel hinged to the bottom panel, an inner front panel hinged to the outer front panel and including a tab received in a slot formed in the bottom panel adjacent the outer front panel, and lateral panels hinged to opposite edges of the outer front panel, the lateral panels being disposed parallel to the side panels and received between the inner and outer side panels;

a first display member separate from and removeably connected to the tray member, the first display member including a first display panel for displaying promotional information regarding the first products within the tray member, and a first pair of wing panels hinged to opposite edges of the first display panel and extending substantially perpendicular therefrom, the first pair of wing panels being parallel to the side panels and disposed between the lateral panels and the outer side panels with the first display panel in surface abutting relationship with the front panel, and wherein engagement of the first pair of wing panels with the side panels removeably connects the first display member with the tray member; and a second display member separate from and removeably connected to the tray member with the first display member removed from the tray member, the second display member including a second display panel for displaying promotional information regarding the second products within the tray member with the first products removed from the tray member, and a second pair of wing panels hinged to opposite edges of the second display panel and extending substantially perpendicular therefrom, the second pair of wing panels being parallel to the side panels and disposed between the lateral panels and the outer side panels with the second display panel in surface abutting relationship with the front panel with the first display panel removed therefrom, and wherein engagement of the second pair of wing panels with the side panels removeably connects the second display member with the tray member with the first display member removed therefrom.

14. The display tray of claim 13, wherein the first and second display members are made from unitary blanks of stiff material.

15. The display tray of claim 14, wherein the stiff material of the tray and first and second display members is selected from the group consisting of cardboard, corrugated paper, bristol board and stiff plastic.

16. The display tray of claim 13, wherein the front panel is of lesser height than the rear panel.

17. The display tray of claim 13, wherein the first and second display panels each include an upper portion and a lower portion extending downwardly from the bottom panel for engaging a front of a shelf on which the display tray is placed.

18. The display tray of claim 17, wherein each of the upper and lower portions of the first and second display panels are connected via a fold line, and wherein each lower portion is foldable between a first position underneath the bottom panel and a second position extending substantially perpendicular to and downwardly from the bottom panel.

* * * * *